US010795278B2

(12) United States Patent
Kawasaki

(10) Patent No.: US 10,795,278 B2
(45) Date of Patent: Oct. 6, 2020

(54) IMAGE FORMING APPARATUS AND METHOD FOR CONTROLLING IMAGE FORMING APPARATUS

(71) Applicant: Koichi Kawasaki, Kanagawa (JP)

(72) Inventor: Koichi Kawasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/749,020

(22) Filed: Jan. 22, 2020

(65) Prior Publication Data

US 2020/0241437 A1 Jul. 30, 2020

(30) Foreign Application Priority Data

Jan. 29, 2019 (JP) ..... 2019-013649

(51) Int. Cl.
*G03G 15/00* (2006.01)
*G03G 15/02* (2006.01)
*G03G 15/06* (2006.01)

(52) U.S. Cl.
CPC ..... *G03G 15/0266* (2013.01); *G03G 15/0283* (2013.01); *G03G 15/065* (2013.01); *G03G 15/5004* (2013.01); *G03G 15/80* (2013.01)

(58) Field of Classification Search
CPC ..... G03G 15/0266; G03G 15/80; G03G 15/0283; G03G 15/5004; G03G 15/065
See application file for complete search history.

(56) References Cited

U.S. PATENT DOCUMENTS 3,663,944 A * 5/1972 Low ..... H02M 3/3384 363/133
4,242,911 A * 1/1981 Martin ..... G01S 7/52046 73/620
5,171,949 A * 12/1992 Fujishima ..... H02M 3/3385 219/716
5,889,660 A * 3/1999 Taranowski ..... H01F 27/2804 315/219
6,332,064 B1 12/2001 Sato et al.
7,228,085 B2 * 6/2007 Shin ..... G03G 15/01 399/88

(Continued)

FOREIGN PATENT DOCUMENTS

JP 2000-081773 3/2000
JP 2000-105523 4/2000
JP 2010-204212 9/2010

*Primary Examiner* — G. M. A Hyder
(74) *Attorney, Agent, or Firm* — IPUSA, PLLC

(57) ABSTRACT

An image forming apparatus includes a photoconductor, a charging roller configured to charge the photoconductor, and a self-excited oscillation circuit. The image forming apparatus includes a transformer including a primary coil and a secondary coil, the transformer being configured to produce, at the secondary coil, a voltage applied to the charging roller, in accordance with the primary coil being driven by the self-excited oscillation circuit. The image forming apparatus includes a controller configured to control, at start-up of the self-excited oscillation circuit, the self-excited oscillation circuit to allow an amount of a current flowing through the primary coil to be larger than an amount of a current flowing from the photoconductor through the secondary coil, via the charging roller.

11 Claims, 6 Drawing Sheets

(56) References Cited

U.S. PATENT DOCUMENTS

| | | | | |
|---|---|---|---|---|
| 2004/0240898 | A1* | 12/2004 | Nonaka | G03G 15/2039 399/33 |
| 2007/0018589 | A1* | 1/2007 | Saito | H01L 41/044 315/209 PZ |
| 2007/0147858 | A1* | 6/2007 | Inukai | G03G 15/0208 399/31 |
| 2010/0272463 | A1* | 10/2010 | Inukai | G03G 15/80 399/88 |
| 2013/0236203 | A1* | 9/2013 | Nakajima | H02M 3/28 399/88 |
| 2014/0186067 | A1* | 7/2014 | Inukai | H02M 3/33507 399/88 |
| 2017/0090331 | A1* | 3/2017 | Kawaguchi | G03G 15/0266 |
| 2019/0079429 | A1* | 3/2019 | Kawaguchi | G03G 15/043 |
| 2019/0346789 | A1 | 11/2019 | Kawasaki | |

* cited by examiner

IMAGE FORMING APPARATUS AND METHOD FOR CONTROLLING IMAGE FORMING APPARATUS

CROSS-REFERENCE TO RELATED APPLICATION

The present application claims priority under 35 U.S.C. § 119 to Japanese Patent Application No. 2019-013649, filed Jan. 29, 2019, the contents of which are incorporated herein by reference in their entirety.

BACKGROUND OF THE INVENTION

1. Field of the Invention

The present disclosure relates to an image forming apparatus and a method for controlling the image forming apparatus.

2. Description of the Related Art

In order to provide good image quality during an emergency shutdown of an image forming apparatus, without storing, in a photoconductor, an electric charge having an opposite polarity with respect to a normally provided polarity, Japanese Unexamined Patent Application Publication No. 2000-105523, which is hereafter referred to as Patent document 1, discloses an image forming apparatus that neutralizes an electric charge stored in the photoconductor when the image forming apparatus is shut down in an emergency, the electric charge having the opposite polarity with respect to the normally provided polarity.

SUMMARY OF THE INVENTION

One or more embodiments provide an image forming apparatus including: a photoconductor; a charging roller configured to charge the photoconductor; a self-excited oscillation circuit; a transformer including a primary coil and a secondary coil, the transformer being configured to produce, at the secondary coil, a voltage applied to the charging roller, in accordance with the primary coil being driven by the self-excited oscillation circuit; and a controller configured to control, at start-up of the self-excited oscillation circuit, the self-excited oscillation circuit to allow an amount of a current flowing through the primary coil to be larger than an amount of a current flowing from the photoconductor through the secondary coil, via the charging roller.

DETAILED DESCRIPTION OF THE EMBODIMENTS

First Embodiment

A first embodiment will be hereinafter described with reference to drawings.

<Configuration of Image Forming Mechanism 10A in Image Forming Apparatus 10>

Figure 1:
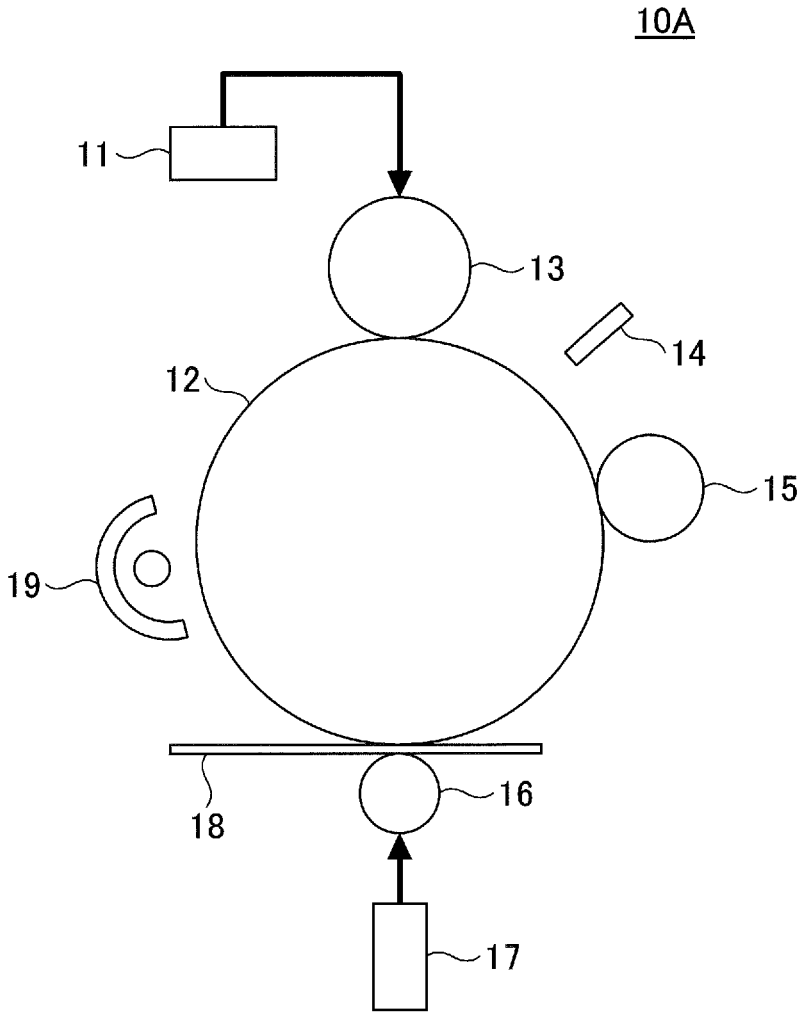
FIG. 1 is a diagram illustrating an example of a configuration of an image forming mechanism in an image forming apparatus according to a first embodiment.

FIG. 1 is a diagram illustrating an example of a configuration of an image forming mechanism 10A in an image forming apparatus 10 according to the first embodiment.

As illustrated in FIG. 1, the image forming mechanism 10A includes a high voltage power supply 11, a photoconductor 12, a charging roller 13, and an exposure unit 14. The image forming mechanism 10A includes a developing roller 15, a first transfer roller 16, a high voltage power supply 17, an intermediate belt 18, and a neutralizer 19.

The high voltage power supply 11 produces a voltage and applies the voltage to the charging roller 13. The charging roller 13 uniformly charges the photoconductor 12. The exposure unit 14 exposes the photoconductor 12 in accordance with print data to form an electrostatic latent image on a surface of the uniformly charged photoconductor 12.

The developing roller 15 adheres toner adhered to a surface of the developing roller 15, to the electrostatic latent image formed on the surface of the photoconductor 12. Thereby, the developing roller 15 forms a toner image on the surface of the photoconductor 12.

The toner image formed on the surface of the photoconductor 12 is transferred to the intermediate belt 18, between the photoconductor 12 and the first transfer roller 16 to which a voltage is applied by the high voltage power supply 17. In such a manner, a toner image is formed on the intermediate belt 18.

The toner image formed on the intermediate belt 18 is transferred to a print paper by a second transfer unit (not illustrated). Then, the print paper is fixed with heat and pressure treatment, by a fixing device (not illustrated).

The neutralizer 19 neutralizes an electric charge (charge with a normally provided polarity) stored on the surface of the photoconductor 12. Note that in case of color printing, the image forming apparatus 10 includes image forming mechanisms 10A for respective print colors (e.g., four print colors (Y, C, M, and K)). Where, "Y," "M," "C," and "K respectively represent yellow, magenta, cyan, and black. In such a manner, the image forming apparatus 10 can form multicolored toner images on the intermediate belt 18.

(Configuration of High Voltage Power Supply 11 in Image Forming Apparatus 10)

Figure 2:
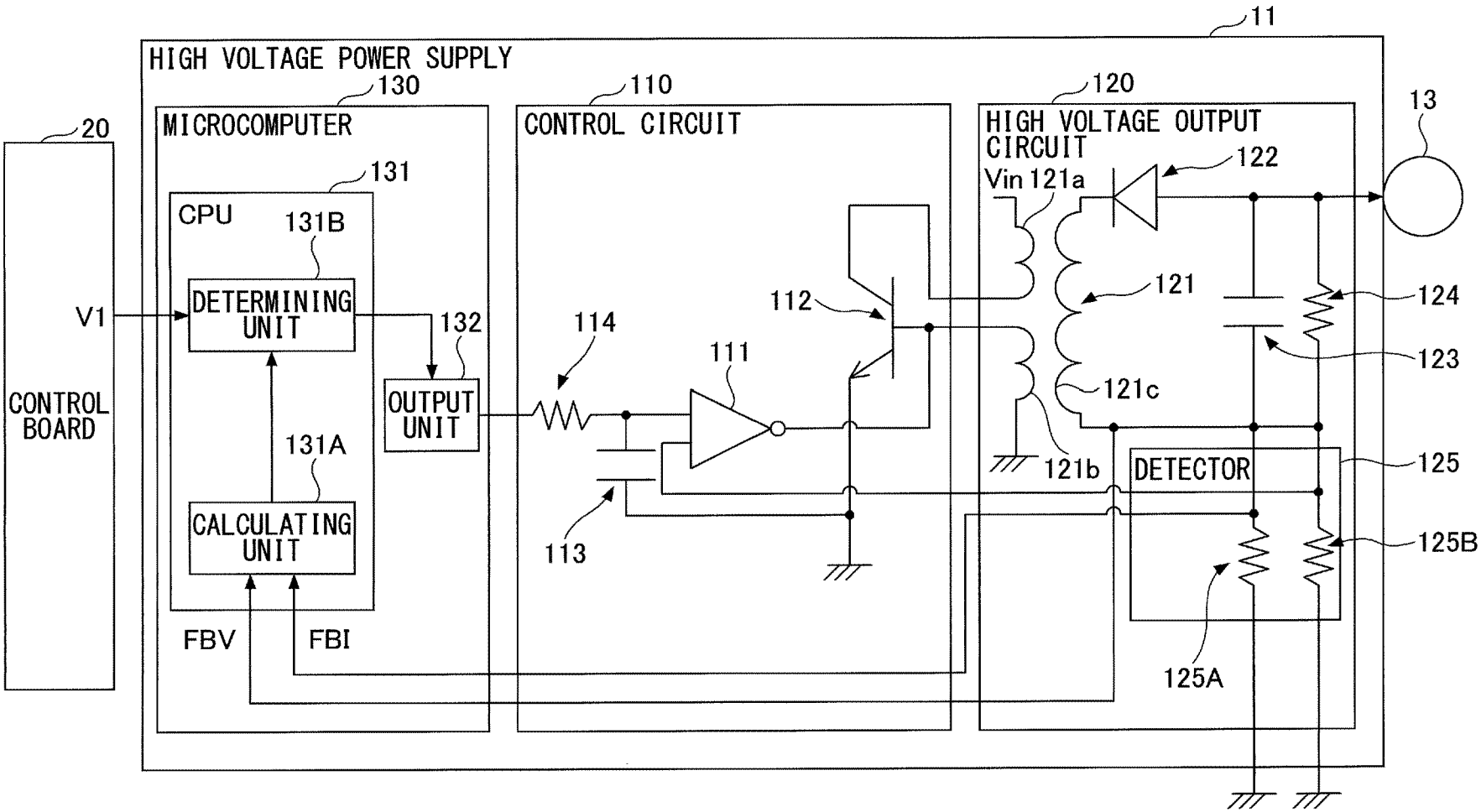
FIG. 2 is a diagram illustrating an example of a configuration of a high voltage power supply in the image forming apparatus according to the first embodiment.

FIG. 2 is a diagram illustrating an example of a configuration of the high voltage power supply 11 in the image forming apparatus 10 according to the first embodiment. As illustrated in FIG. 2, the high voltage power supply 11 includes a control circuit 110, a high voltage output circuit 120, and a microcomputer 130.

The control circuit 110 includes an operational amplifier 111, a transistor 112, a capacitor 113, and a resistor 114. Note that the transistor 112, the capacitor 113, and the resistor 114 configure a "self-excited oscillation circuit."

With respect to the operational amplifier 111, a control signal (indication voltage V2) output from the microcomputer 130 is applied to a non-inverting input terminal. Also, a voltage detected by a detector 125 is applied to an inverting input terminal of the operational amplifier 111. An output terminal of the operational amplifier 111 is connected to a base of a transistor 112. The operational amplifier 111 controls an amount of a base current applied to the base of the transistor 112. Thus, the operational amplifier 111 causes a voltage (i.e., a voltage applied to the charging roller 13) applied to the inverting input terminal to be equal to the indication voltage V2 applied to the non-inverting input terminal.

The base of the transistor 112 is connected to both of an output terminal of the operational amplifier 111 and a primary coil 121*b* of the transformer 121. A collector is connected to a primary coil 121*a* of the transformer 121, and an emitter is grounded. When a base current flowing from the operational amplifier 111 is applied to the transistor 112, a collector current flows between a collector terminal and an emitter terminal. Thereby, the transistor 112 can control a current flow to the primary coil 121*a* that is connected to the collector. Note that when an amount of a base current is adjusted, the transistor 112 can adjust an amount of a collector current (i.e., an amount of a current flowing through the primary coil 121*a*).

The capacitor 113 and the resistor 114 configure an RC filter circuit to smooth a control signal that is applied to the operational amplifier 111 and that is output from the microcomputer 130.

The high voltage output circuit 120 includes the transformer 121, a diode 122, a capacitor 123, a resistor 124, and the detector 125.

The transformer 121 includes the primary coil 121*a*, the primary coil 121*b*, and a secondary coil 121*c*.

One end of the primary coil 121*a* is connected to a power input terminal Vin. The other end of the primary coil 121*a* is connected to the collector of the transistor 112.

One end of the primary coil 121*b* is connected to the base of the transistor 112. The other end of the primary coil 121*b* is grounded.

When a current applied from the power input terminal Vin flows into the primary coil 121*a*, the transformer 121 produces an AC (alternating current) voltage at the secondary coil 121, due to a reciprocal inductive action.

The AC voltage produced at the secondary coil 121*c* is rectified by the diode 122 and the capacitor 123 and thus is converted into a DC (direct current) voltage. The DC voltage is applied to the charging roller 13.

The detector 125 includes a resistor 125A and a resistor 1258 that are connected in series with the secondary coil 121*c*. In such a manner, the detector 125 detects an amount of a current flowing through the secondary coil 121*c*, as well as a voltage value (voltage value divided by the resistor 124 and the resistor 125B) of a voltage produced at the secondary coil 121*c*.

The current amount and voltage value detected by the detector 125 are fed back to the microcomputer 130. The voltage value detected by the detector 125 is fed back to the operational amplifier 111 in the control circuit 110.

In the following description, the voltage value fed back to the microcomputer 130 by the detector 125 is referred to as a "feedback voltage value FBV". The amount of a current fed back to the microcomputer 130 by the detector 125 is referred to as a "feedback current value FBI".

The microcomputer 130 is an example of a "controller". The microcomputer 130 includes a central processing unit (CPU) 131 and an output unit 132.

The CPU 131 determines a voltage value of an indication voltage V2 that is supplied to the control circuit 110, based on an indication voltage V1 output from a control board 20; and a feedback voltage value FBV and feedback current value FBI output from the detector 125. In this example, the CPU 131 includes a calculating unit 131A and a determining unit 131B.

The calculating unit 131A calculates a surface potential (residual potential) at the photoconductor 12 based on a feedback current value FBI. For example, the calculating unit 131A calculates a surface potential at the photoconductor 12 based on a feedback current value FBI, by using a predetermined relation equation or the like, where the relation equation represents a relationship between the feedback current value FBI and the surface potential at the photoconductor 12.

The determining unit 131B compares a surface potential calculated by the calculating unit 131A, with an indication voltage V1 output from the control board 20. When the surface potential calculated by the calculating unit 131A is higher than the indication voltage V1 output from the control board 20, the determining unit 131B selects a value of a voltage higher than the surface potential calculated by the calculating unit 131A, as a voltage value of the indication voltage V2 for being supplied to the control circuit 110.

For example, the determining unit 131B multiplies a surface potential calculated by the calculating unit 131A by a predetermined coefficient to calculate a voltage value of an indication voltage V2 for being supplied to the control circuit 110. On the other hand, when the surface potential calculated by the calculating unit 131A is lower than the indication voltage output from the control board 20, the determining unit 131B selects a voltage value of an indication voltage V1 output from the control board 20, as a voltage value of an indication voltage V2 for being supplied to the control circuit 110.

In other words, at start-up of a self-excited oscillation circuit, when a surface potential calculated by the calculating unit 131A is higher than an indication voltage V1 output from the control board 20, the determining unit 131B temporarily increases a voltage value of an indication voltage V2 for being supplied to the control circuit 110, to be greater than a voltage value of the indication voltage V1 output from the control board 20. When a condition for terminating a period of controlling an indication voltage as described below is met, the determining unit 131B sets back a voltage value of the indication voltage V2 for being supplied to the control circuit 110, to a voltage value of the indication voltage V1 output from the control board 20.

The output unit 132 outputs a control signal that conveys an indication voltage V2 selected by the CPU 131, to the control circuit 110.

In such a manner, when a voltage value of the indication voltage V2 is temporarily increased to be greater than a voltage value of the indication voltage V1, by the determining unit 131B, the output unit 132 outputs, to the control circuit 110, a control signal that conveys the indication voltage V2 whose magnitude is temporarily increased.

When a voltage value of the indication voltage V2 is set back to a voltage value of the indication voltage V1, by the determining unit 131B, the output unit 132 outputs, to the control circuit 110, a control signal that conveys an indication voltage V2 whose magnitude is set back.

For example, the output unit 132 outputs, to the control circuit 110, a control signal having a rectangular waveform and representing a duty cycle of a given indication voltage V2. As an example, when an indication voltage V2 is "600 V," the output unit 132 outputs a control signal representing a duty cycle of "60%" to the control circuit 110. When an indication voltage V2 is "850 V," the output unit 132 outputs a control signal representing a duty cycle of "85%" to the control circuit 110.

(Process by Microcomputer 130)

Figure 3:
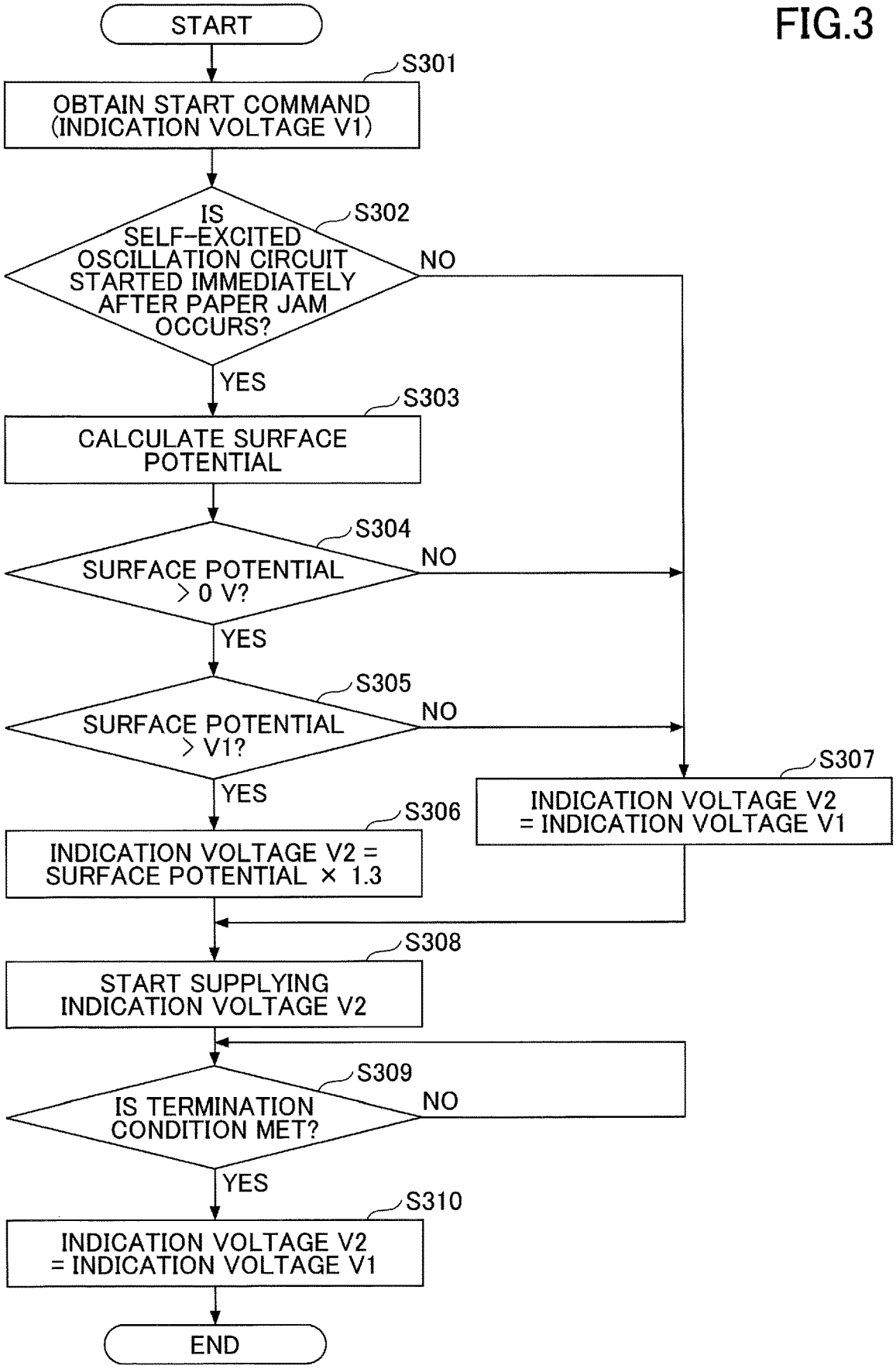
FIG. 3 is a flowchart illustrating an example of a process by a microcomputer in the image forming apparatus according to the first embodiment.

FIG. 3 is a flowchart illustrating an example of a process by the microcomputer 130 in the image forming apparatus 10 according to the present embodiment.

First, the CPU 131 obtains a start command from the control board 20 (step S301). The start command includes an indication voltage V1.

Next, the CPU 131 determines whether a self-excited oscillation circuit is started immediately after a paper jam occurs (step S302).

In step S302, when a self-excited oscillation circuit is determined not to be started immediately after a paper jam occurs (NO in step S302), the determining unit 131B selects a voltage value of an indication voltage V1 output from the control board 20, as a voltage value of an indication voltage V2 for being supplied to the control circuit 110 (step S307). Then, the microcomputer 130 proceeds to the process in step S308.

On the other hand, in step S302, when a self-excited oscillation circuit is determined to be started immediately after a paper jam occurs (YES in step S302), the calculating unit 131A calculates a surface potential (residual potential) at the photoconductor 12, based on a feedback current value FBI from the detector 125 (step S303). Then, the calculating unit 131A determines whether the surface potential calculated in step S303 is higher than 0 V (step S304).

In step S304, when the surface potential is determined to be higher than 0 V (YES in step S304), the determining unit 131B determines whether the surface potential calculated in step S303 is higher than the indication voltage V1 (step S305).

In step S305, when the surface potential is determined to be higher than the indication voltage V1 (YES in step S305), the determining unit 131B multiplies the surface potential calculated in step S303 by a predetermined coefficient (in this flow, "1.3" as an example) to calculate a voltage value of an indication voltage V2 for being supplied to the control circuit 110 (step S307). Then, the microcomputer 130 proceeds to the process in step S308.

On the other hand, in step S304, when the surface potential is determined to be 0 V (NO in step S304); or in step S305, when the surface potential is determined to be lower than or equal to the indication voltage V1 (NO in step S305), the determining unit 131B selects a voltage value of the indication voltage V1 output from the control board 20, as a voltage value of an indication voltage V2 for being supplied to the control circuit 110 (step S307). Then, the microcomputer 130 proceeds to the process in step S308.

In step S308, the output unit 132 starts supplying the indication voltage V2 selected in step S306 or step S307, to the control circuit 110. Thereby, the control circuit 110 and the high voltage output circuit 120 operate.

Subsequently, the determining unit 131B determines whether a condition for terminating a period for temporarily increasing a voltage value of an indication voltage V2 (hereinafter referred to as a "control period of an indication voltage"), is met (step S309).

In step S309, when it is determined that a condition for terminating a control period of an indication voltage is not met (No in step S309), the determining unit 131B executes the process in step S309 again.

On the other hand, in step S309, when it is determined that a condition for terminating a control period of an indication voltage is met (YES in step S309), the determining unit 1318 changes a voltage value of the indication voltage V2 for being supplied to the control circuit 110, to be equal to the indication voltage V1 output from the control board 20; or maintains a voltage value of the indication voltage V2 (step S310). Then, the microcomputer 130 finishes taking a series of steps illustrated in FIG. 3.

(Specific Manner of Start-Up Operation of High Voltage Power Supply 11)

Figure 4:
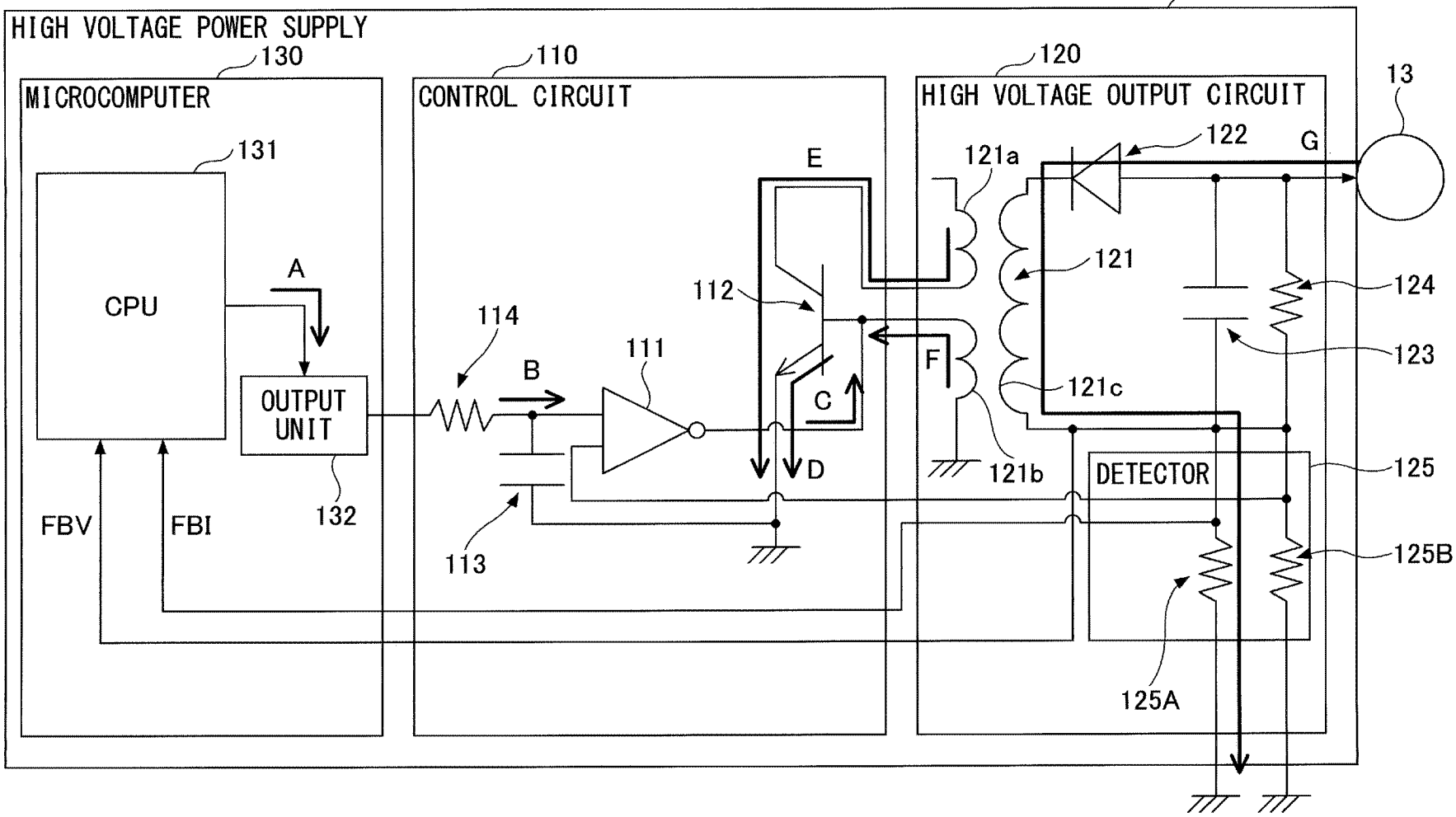
FIG. 4 is a diagram illustrating a specific manner of start-up operation of the high voltage power supply in the image forming apparatus according to the first embodiment.

FIG. 4 is a diagram illustrating a specific manner of start-up operation of the high voltage power supply 11 in the image forming apparatus 10 according to the present embodiment. In this description, as an example, an indication voltage V1 output from the control board 20 is "600 V"; a surface potential at the photoconductor 12 is "654 V"; and a predetermined coefficient is "1.3."

Note that the predetermined coefficient may be taken as any value as long as such a coefficient is greater than "1." However, if the predetermined coefficient is excessively great, an abnormal oscillation in the self-excited oscillation circuit may be created. For this reason, the predetermined coefficient is taken as an appropriate value being greater than "1" and being preliminarily determined by simulation or the like.

First, the CPU 131 gives an indication voltage V2 to the output unit 132 (arrow A in FIG. 4). In this example, a surface potential (654 V) at the photoconductor 12 is higher than an indication voltage V1 (600 V). In this case, an indication voltage V2 is "850 V" given by {surface potential (654 V)×predetermined coefficient (1.3)}.

Next, the output unit 132 outputs a control signal representing the indication voltage V2 (850 V) to the operational amplifier 111 (arrow B in FIG. 4). The operational amplifier 111 controls an amount of a base current flowing to the transistor 112 (arrow C in FIG. 4) and thus a voltage applied to the charging roller 13 is equal to the indication voltage V2.

In such a manner, a base current flows to the transistor 112 (arrow D in FIG. 4), and a collector current flows to the primary coil 121*a* and the transistor 112 (arrow E in FIG. 4).

In this example, an amount (e.g., a current amount corresponding to the indication voltage V2="850 V") of a current flowing through the primary coil 121*a* (arrow E in FIG. 4) is larger than an amount (e.g., a current amount corresponding to the surface potential="654 V" at the photoconductor 12) of a current flowing from the charging roller 13 through the secondary coil 121*c* (arrow G in FIG. 4). In this case, a current flows from the primary coil 121*b* to the base of the transistor 112 (arrow F in FIG. 4). Thereby, the self-excited oscillation circuit successfully oscillates.

In the example of FIG. 4, if the indication voltage V2 is set to "600 V", which is equal to the indication voltage V1, an amount of a current flowing through the primary coil 121*a* (e.g., a current amount corresponding to the indication voltage V2="600 V") is smaller than an amount of a current flowing from the charging roller 13 through the secondary coil 121*c* (e.g., a current amount corresponding to the surface potential="654 V" at the photoconductor 12). As a result, a current does not flow to the base of the transistor 112 and thus the self-excited oscillation circuit may be unable to oscillate successfully.

As described above, at start-up of the self-excited oscillation circuit, the image forming apparatus 10 according to the present embodiment temporarily increases the indication voltage V2 to be higher than the indication voltage V1. Thereby, the self-excited oscillation circuit can be successfully started, even when a charge of opposite polarity is stored by the photoconductor 12.

Note, that after the self-excited oscillation circuit is started successfully, if the indication voltage V2 temporarily continues to be increased, a voltage applied to the charging roller 13 may be higher than the indication voltage V1.

In light of the issue, in the present embodiment, the image forming apparatus 10 sets back a voltage value of the indication voltage V2, from a temporarily increased voltage value (e.g., "850 V") to a voltage value (e.g., "600 V") of the indication voltage V1, when any of the following conditions for terminating a control period of an indication voltage is met. Thereby, the image forming apparatus 10 according to the present embodiment can prevent a voltage applied to the charging roller 13 from being higher than the indication voltage V1.

(First Example for Condition for Terminating a Control Period of Indication Voltage)

As a first example, the microcomputer 130 determines whether to terminate a control period of an indication voltage based on a feedback voltage value FBV. For example, after the self-excited oscillation circuit is started, the microcomputer 130 repeatedly calculates an output voltage value of the high voltage output circuit 120, based on a feedback voltage value FBV. In such a manner, the microcomputer 130 monitors the output voltage value of the high voltage output circuit 120, after start-up of the self-excited oscillation circuit. When the output voltage value of the high voltage output circuit 120 reaches a voltage value (e.g., "600 V") of the indication voltage V1, the microcomputer 130 determines to terminate a control period of an indication voltage. Note that the control period of an indication voltage is limited to being terminated in the case where an output voltage value of the high voltage output circuit 120 reaches a voltage value of the indication voltage V1. The control period of an indication voltage may be terminated when an output voltage value of the high voltage output circuit 120 reaches a voltage value in a case where the self-excited oscillation circuit oscillates stably.

(Second Example for Condition for Terminating a Control Period of Indication Voltage)

As a second example, the microcomputer 130 determines whether to terminate a control period of an indication voltage, based on a feedback current value FBI. For example, after the self-excited oscillation circuit is started, the microcomputer 130 repeatedly obtains a feedback current value FBI. In such a manner, the microcomputer 130 monitors the output current value of the high voltage output circuit 120, after start-up of the self-excited oscillation circuit. When the feedback current value FBI reaches a predetermined target current value, the microcomputer 130 terminates a control period of an indication voltage. In this case, the predetermined target current value may be a preset fixed value, or a variable value that is calculated by a predetermined calculation formula using an indication voltage V1 or the like. In either case, the predetermined target current value is preferably taken as a current value in a case where the self-excited oscillation circuit oscillates stably after start-up of the self-excited oscillation circuit.

(Third Example for Condition for Terminating a Control Period of Indication Voltage)

As a third example, the microcomputer 130 determines whether to terminate a control period of an indication voltage based on a time elapsed after starting start-up of the self-excited oscillation circuit. For example, when a time elapsed after starting start-up of the self-excited oscillation circuit reaches a predetermined time, the microcomputer 130 terminates a control period of an indication voltage. In this case, the predetermined time may be expressed by a preset fixed value or a variable value that is calculated by a predetermined calculation formula using an indication voltage V1 or the like. In either case, the predetermined time is preferably taken as a time until when the self-excited oscillation circuit oscillates stably. For example, when it is known that a time required for the self-excited oscillation circuit to complete start-up is "30 ms"; and a ratio of a time required for the self-excited oscillation circuit to oscillate stably, expressed as a percentage of a time required for the self-excited oscillation circuit to complete start-up is "66%," the predetermined time may be set to "20 ms (approximately 30×0.66)."

(Fourth Example for Condition for Terminating a Control Period of Indication Voltage)

As a fourth example, the microcomputer 130 determines whether to terminate a control period of an indication voltage based on completion timing of a printing process by the image forming apparatus 10. For example, after start-up of the self-excited oscillation circuit, when a first paper is printed completely in a printing process, the microcomputer 130 terminates a control period of an indication voltage. When a printing process of a single paper is finished, residual potential at the photoconductor 12 is not present. For this reason, there is no problem if a voltage value of the indication voltage V2 is set back.

As described above, the image forming apparatus 10 according to the first embodiment includes the microcomputer 130 that controls a self-excited oscillation circuit. Thus, at start-up of the self-excited oscillation circuit, an amount of a current flowing through the primary coil 121*a* is larger than an amount of a current that flows from the photoconductor 12 through the secondary coil 121*c*, via the charging roller 13. Thereby, in the first embodiment, at start-up of the self-excited oscillation circuit, even when a charge of opposite polarity is stored by the photoconductor 12, the image forming apparatus 10 allows an amount of a current flowing through the primary coil 121*a* to be larger than an amount of current flowing from the photoconductor 12 through the secondary coil 121*c*, via the charging roller 13. Accordingly, the self-excited oscillation circuit of the high voltage power supply 11 can oscillate successfully.

In particular, with respect to the image forming apparatus 10 according to the first embodiment, when a surface potential at the photoconductor 12 is higher than a given indication voltage V1, the microcomputer 130 temporarily increases an indication voltage V2 for being supplied to the self-excited oscillation circuit, to be higher than a surface potential at the photoconductor 12. In such a manner, the self-excited oscillation circuit can be controlled and thus an amount of a current flowing through the primary coil 121*a* is larger than an amount of a current flowing from the photoconductor 12 through the secondary coil 121*c*, via the charging roller 13. Thereby, without changing a configuration of a control circuit 110 or a high voltage output circuit 120; or including a neutralizer for neutralizing a charge of opposite polarity, the image forming apparatus 10 according to the first embodiment performs relatively simple control such as merely changing an indication voltage V2. Thus, an amount of a current flowing through the primary coil 121*a* can be larger than an amount of a current flowing from the photoconductor 12 through the secondary coil 121*c*, via the charging roller 13.

With respect to the image forming apparatus 10 according to the first embodiment, the microcomputer 130 temporarily increases an indication voltage V2 for being supplied to the self-excited oscillation circuit. Then, the microcomputer 130 sets back the indication voltage V2 for being supplied to the self-excited oscillation circuit to a given indication voltage V1, when a predetermined termination condition is met. Thereby, in the first embodiment, the image forming apparatus 10 allows the self-excited oscillation circuit of the high voltage power supply 11 to oscillate successfully, as well as being able to control a voltage applied to the charging roller 13 without being higher than the indication voltage V1.

With respect to the image forming apparatus 10 according to the first embodiment, when the self-excited oscillation circuit is started immediately after a paper jam occurs, the microcomputer 130 controls the self-excited oscillation circuit and thus an amount of a current flowing through the primary coil 121*a* is larger than an amount of a current flowing from the charging roller 13 through the secondary coil 121*c*. In other words, the image forming apparatus 10 according to the first embodiment performs control at start-up of the self-excited oscillation circuit to temporarily increase an indication voltage V2 only in a case of a current flowing from the photoconductor 12 via the charging roller 13. Accordingly, undesirable control can be avoided.

Second Embodiment (Configuration of High Voltage Power Supply 11A Included in Image Forming Apparatus 10)

Figure 5:
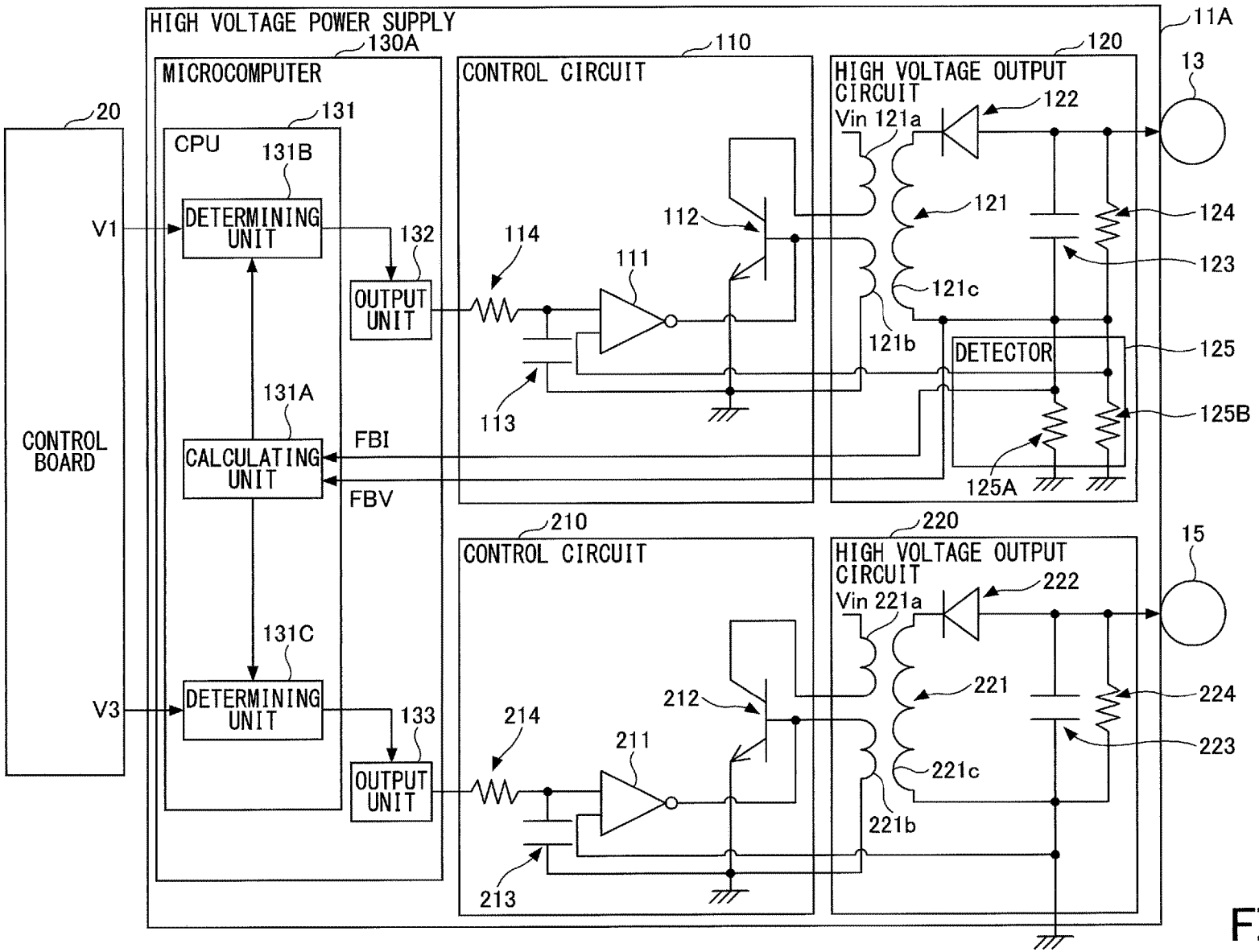
FIG. 5 is a diagram illustrating an example of a configuration of a high voltage power supply in an image forming apparatus according to a second embodiment.

FIG. 5 is a diagram illustrating an example of a configuration of a high voltage power supply 11A included in an image forming apparatus 10 according to a second embodiment. In the following description, explanation will be mainly provided for the configuration of the high voltage power supply 11A that differs from the high voltage power supply 11 according to the first embodiment.

As illustrated in FIG. 5, the high voltage power supply 11A includes a control circuit 110, a high voltage output circuit 120, a microcomputer 130A, a control circuit 210, and a high voltage output circuit 220. The control circuit 110 and the high voltage output circuit 120 have the same configuration as the control circuit and the high voltage output circuit of the high voltage power supply 11 that has been described in the first embodiment; accordingly, the explanation for the control circuit 110 and the high voltage output circuit 120 will not be provided.

The control circuit 210 has the same configuration as the control circuit 110. The control circuit 210 includes an operational amplifier 211, a transistor 212, a capacitor 213, and a resistor 214. A "second self-excited oscillation circuit" is configured by the transistor 212, the capacitor 213, and the resistor 214.

With respect to the operational amplifier 211, a control signal (indication voltage V4) output from the microcomputer 130A is applied to a non-inverting input terminal. Also, a voltage produced at a secondary coil 221*c* is applied to an inverting input terminal of the operational amplifier 211. An output terminal of the operational amplifier 211 is connected to a base of the transistor 212. The operational amplifier 211 controls an amount of a base current applied to the base of the transistor 212. Thus, a voltage (in this example, a voltage applied to a developing roller 15) applied from the inverting input terminal is equal to an indication voltage V4 applied from the non-inverting input terminal.

The base of the transistor 212 is connected to the output terminal of the operational amplifier 211 and a primary coil 221*b* of the transformer 221. A collector is connected to a primary coil 221*a* of the transformer 221, and an emitter is grounded. When a base current applied from the operational amplifier 211 is applied to the transistor 212, a collector current flows between a collector terminal and an emitter terminal. In such a manner, the transistor 212 can control a current flow to the primary coil 221*a* connected to the collector. Note that when an amount of a base current is regulated, the transistor 212 can regulate an amount of a collector current (in this example, an amount of a current flowing through the primary coil 221*a*).

The capacitor 213 and the resistor 214 configure an RC filter circuit to smooth a control signal that is applied to the operational amplifier 211 and that is output from the microcomputer 130A.

The high voltage output circuit 220 includes a transformer 221, a diode 222, a capacitor 223, and a resistor 224.

The transformer 221 includes a primary coil 221*a*, a primary coil 221*b*, and a secondary coil 221*c*.

One end of the primary coil 221*a* is connected to a power input terminal Vin. The other end of the primary coil 221*a* is connected to the collector of the transistor 212.

One end of the primary coil 221*b* is connected to the base of the transistor 212. The other end of the primary coil 221*b* is grounded.

When a current applied from the power input terminal Vin flows to the primary coil 221*a*, an AC voltage is produced at the secondary coil 221*c* due to a reciprocal inductive action.

The AC voltage produced at the secondary coil 221*c* is rectified by the diode 222 and the capacitor 223, and thus is converted to a DC voltage. The DC voltage is applied to a developing roller 15.

The microcomputer 130A differs from the microcomputer 130, in that a determining unit 131C is further included in a CPU 131; and an output unit 133 is further included.

The determining unit 131C selects a value of voltage higher than an indication voltage V3, as a voltage value of an indication voltage V4 for being supplied to the control circuit 210, when a surface potential calculated by the calculating unit 131A is higher than an indication voltage V1 given by a control board 20 (e.g., when an indication voltage V2 is increased). In particular, the determining unit 131C selects, as a voltage value of an indication voltage V4, a voltage value obtained by adding a value equivalent to an increment of an indication voltage V1 with respect to the indication voltage V2, to an indication voltage V3.

The output unit 133 outputs a control signal representing an indication voltage V4 selected by the CPU 131, to the control circuit 210. In other words, when a voltage value of an indication voltage V4 is increased from a voltage value of an indication voltage V3, by the determining unit 131C, the output unit 133 outputs a control signal representing an indication voltage V4 whose magnitude is increased, to the control circuit 210.

(Process by Microcomputer 130A)

Figure 6:
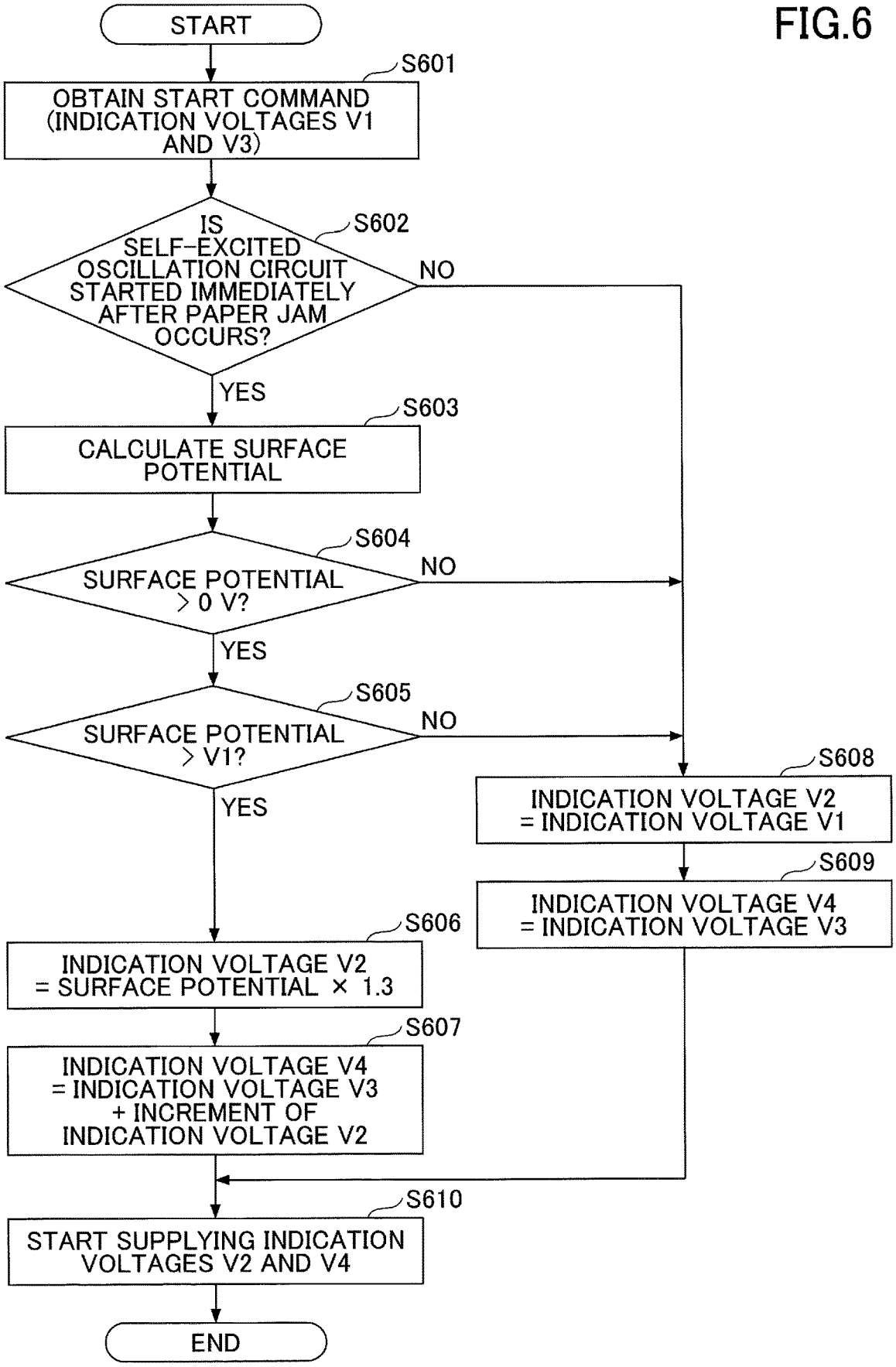
FIG. 6 is a flowchart illustrating an example of a process by a microcomputer in the image forming apparatus according to the second embodiment.

FIG. 6 is a flowchart illustrating an example of a process by the microcomputer 130A included in the image forming apparatus 10 according to the second embodiment.

First, the CPU 131 obtains a start command from the control board 20 (step S601). This start command includes indication voltages V1 and V3.

Next, the CPU 131 determines whether the self-excited oscillation circuit is started immediately after a paper jam occurs (step S602).

In step S602, when the self-excited oscillation circuit is determined not to be started immediately after a paper jam occurs (No in step S602), the determining unit 131B selects a voltage value of the indication voltage V1 given by the control board 20, as a voltage value of an indication voltage V2 for being supplied to the control circuit 110 (step S608). The determining unit 131C selects a voltage value of the indication voltage V3 given by the control board 20, as a voltage value of an indication voltage V4 for being supplied to the control circuit 210 (step S609). Then, the microcomputer 130A proceeds to the process in step S610.

On the other hand, in step S602, when the self-excited oscillation circuit is determined to be started immediately after a paper jam occurs (Yes in step S602), the calculating unit 131A calculates a surface potential (residual potential) at the photoconductor 12 based on a feedback current value FBI from the detector 125 (step S603). The calculating unit 131A determines whether the surface potential calculated in step S603 is higher than 0 V (step S604).

In step S604, when the surface potential is determined to be higher than 0 V (YES in step S604), the determining unit 131B determines whether the surface potential calculated in step S603 is higher than the indication voltage V1 (step S605).

In step S605, when the surface potential is determined to be higher than the indication voltage V1 (YES in step S605), the determining unit 131B multiplies the surface potential calculated in step S603 by a predetermined coefficient (in this description, e.g., "1.3") to calculate a voltage value of an indication voltage V2 for being supplied to the control circuit 110 (step S606).

The determining unit 131C adds an increment of the indication voltage V2 with respect to the indication voltage V1, to the indication voltage V3 given by the control board 20. Thereby, the determining unit 131C calculates a voltage value of an indication voltage V4 for being supplied to the control circuit 210 (step S607). Then, the microcomputer 130A proceeds to the process in step S610.

On the other hand, in step S604, when the surface potential is determined to be 0 V (NO in step S604); or in step S605, when the surface potential is determined to be lower than or equal to the indication voltage V1 (NO in step S605), the determining unit 131B selects a voltage value of the indication voltage V1 given by the control board 20, as a voltage value of the indication voltage V2 for being supplied to the control circuit 110 (step S608). The determining unit 131C also selects a voltage value of the indication voltage V3 given by the control board 20, as a voltage value of the indication voltage V4 for being supplied to the control circuit 210. Then, the microcomputer 130A proceeds to the process in step S610.

In step S610, the output unit 132 starts supplying the indication voltage V2 selected in step S606 or step S608, to the control circuit 110. The output unit 132 also starts supplying the indication voltage V4 selected in step S607 or step S609, to the control circuit 210. Thereby, the control circuits 110 and 210 and the high voltage output circuits 120 and 220 are operated. Then, the microcomputer 130A finishes a series of steps illustrated in FIG. 6.

As described above, in the image forming apparatus 10 according to the second embodiment, when a voltage value of a voltage applied to the charging roller 13 is increased to be changed from a value expressing an indication voltage V1 to a value expressing an indication voltage V2, a voltage value of a voltage applied to the developing roller 15 is also increased to be changed from a value expressing the indication voltage V3 to a value expressing the indication voltage V4. Thereby, with respect to the image forming apparatus 10 according to the second embodiment, two self-excited oscillation circuits included in the high voltage power supply 11A can be successfully started, even when an oppositely polar charge is stored by the photoconductor 12.

In particular, in the second embodiment, the image forming apparatus 10 sets an increment of the indication voltage V4 with respect to the indication voltage V3 to be equal to an increment of the indication voltage V2 with respect to the indication voltage V1. Thereby, potential differences between the charging roller 13 and the developing roller 15 are equal in both cases where the indication voltage V2 and indication voltage V4 are increased; and where the indication voltage V2 and indication voltage V4 are not increased.

Note that with respect to the image forming apparatus 10 according to the second embodiment, an indication voltage V2 and indication voltage V4 are increased equally, and thus a potential difference between the charging roller 13 and the developing roller 15 is not varied. In such a manner, a process of setting back each of the indication voltages V2 and V4 to a given preceding value is not executed.

The preferred embodiments and examples have been described in detail above, but the present disclosure is not limited to these embodiments and examples. Various modifications or changes can be made within a scope set forth in the disclosure.

What is claimed is:

1. An image forming apparatus comprising:

a photoconductor;

a charging roller configured to charge the photoconductor;

a self-excited oscillation circuit;

a transformer including a primary coil and a secondary coil, the transformer being configured to produce, at the secondary coil, a voltage applied to the charging roller, in accordance with the primary coil being driven by the self-excited oscillation circuit; and a controller configured to control, at start-up of the self-excited oscillation circuit, the self-excited oscillation circuit to allow an amount of a current flowing through the primary coil to be larger than an amount of a current flowing from the photoconductor through the secondary coil, via the charging roller.

2. The image forming apparatus according to claim 1, wherein in response to detecting that a surface potential at the photoconductor is higher than a given indication voltage, the controller is configured to control the self-excited oscillation circuit to cause an indication voltage supplied to the self-excited oscillation circuit, to be temporarily higher than the surface potential at the photoconductor, in order to allow the amount of the current flowing through the primary coil to be larger than the amount of the current flowing from the photoconductor through the secondary coil, via the charging roller.

3. The image forming apparatus according to claim 2, further comprising:

a detector configured to detect at least one from among a value of the voltage produced at the secondary coil and the amount of the current flowing through the secondary coil; and a calculating unit configured to calculate the surface potential based on the detected at least one from among the value of the voltage produced at the secondary coil and the amount of the current flowing through the secondary coil.

4. The image forming apparatus according to claim 2, wherein, in response to determining that a predetermined condition is met after the indication voltage applied to the self-excited oscillation circuit is temporarily increased, the controller is configured to set back the indication voltage supplied to the self-excited oscillation circuit, to the given indication voltage.

5. The image forming apparatus according to claim 4, wherein the predetermined condition includes a condition in which a value of the voltage produced at the secondary coil reaches a target value.

6. The image forming apparatus according to claim 4, wherein the predetermined condition includes a condition in which the amount of the current flowing through the secondary coil reaches a target amount.

7. The image forming apparatus according to claim 4, wherein the predetermined condition includes a condition in which a time elapsed after start-up of the self-excited oscillation circuit starts reaches a predetermined time.

8. The image forming apparatus according to claim 4, wherein the predetermined condition includes a condition in which a first paper is completely printed after start-up of the self-excited oscillation circuit.

9. The image forming apparatus according to claim 1, wherein in response to determining that the self-excited oscillation circuit is started after a paper jam occurs, the controller is configured to control the self-excited oscillation circuit to allow the amount of the current flowing through the primary coil to be larger than the amount of the current flowing from the photoconductor through the secondary coil, via the charging roller.

10. The image forming apparatus according to claim 1, further comprising a developing roller configured to form a toner image on a surface of the photoconductor;

a second self-excited oscillation circuit; and a second transformer including a second primary coil and a second secondary coil, the second transformer being configured to produce, at the second secondary coil, a voltage applied to the developing roller, in accordance with the second primary coil being driven by the second self-excited oscillation circuit, wherein in response to detecting, at start-up of the self-excited oscillation circuit, that the surface potential at the photoconductor is higher than a given indication voltage, the controller is configured to:

control the self-excited oscillation circuit to cause an indication voltage supplied to the self-excited oscillation circuit, to be temporarily higher than the surface potential at the photoconductor, in order to allow the amount of the current flowing through the primary coil to be larger than the amount of the current flowing from the photoconductor through the secondary coil, via the charging roller; and control the second self-excited oscillation circuit to cause an indication voltage supplied to the second self-excited oscillation circuit, to be temporarily higher than the surface potential at the photoconductor to allow an amount of a current flowing through the second primary coil to be larger than an amount of a current flowing from the photoconductor through the second secondary coil, via the developing roller.

11. A method for controlling an image forming apparatus, the method comprising;

controlling, at start-up of a self-excited oscillation circuit of the image forming apparatus, the self-excited oscillation circuit to allow an amount of a current flowing through a primary coil to be larger than an amount of a current flowing from a photoconductor through the secondary coil, via a charging roller, the image forming apparatus including the photoconductor, the charging roller being configured to charge the photoconductor, the self-excited oscillation circuit, and a transformer including the primary coil and the secondary coil, the transformer being configured to produce, at the secondary coil, a voltage applied to the charging roller, in accordance with the primary coil being driven by the self-excited oscillation circuit.

* * * * *